US011812832B2

(12) United States Patent
Younger

(10) Patent No.: US 11,812,832 B2
(45) Date of Patent: Nov. 14, 2023

(54) ATTACHMENT SYSTEM

(71) Applicant: Jacob Lehman Younger, Macungie, PA (US)

(72) Inventor: Jacob Lehman Younger, Macungie, PA (US)

( * ) Notice: Subject to any disclaimer, the term of this patent is extended or adjusted under 35 U.S.C. 154(b) by 253 days.

(21) Appl. No.: 17/303,983

(22) Filed: Jun. 11, 2021

(65) Prior Publication Data

US 2021/0386168 A1 Dec. 16, 2021

Related U.S. Application Data

(60) Provisional application No. 63/037,893, filed on Jun. 11, 2020.

(51) Int. Cl.

| | |
|---|---|
| ***A45C 7/00*** | (2006.01) |
| ***A45F 3/04*** | (2006.01) |
| ***A45C 13/10*** | (2006.01) |
| ***A45C 13/30*** | (2006.01) |

(52) U.S. Cl.

CPC ..... *A45C 7/0086* (2013.01); *A45C 13/1038* (2013.01); *A45C 13/30* (2013.01); *A45F 3/04* (2013.01); *A45C 2013/306* (2013.01)

(58) Field of Classification Search

CPC ... A45C 7/0086; A45C 13/1038; A45C 13/30; A45C 2013/306; A45F 3/04

USPC ..... 224/259

See application file for complete search history.

(56) References Cited

U.S. PATENT DOCUMENTS

| | | | | |
|---|---|---|---|---|
| 1,131,054 | A * | 3/1915 | Glassman | A41D 13/0012 2/94 |
| 2,143,561 | A * | 1/1939 | Koppelman | A41F 9/025 2/237 |
| 4,350,194 | A | 9/1982 | Brown | |
| 4,491,258 | A | 1/1985 | Jones | |
| 5,012,964 | A | 5/1991 | Falletta et al. | |
| 5,632,071 | A * | 5/1997 | Maunder | E04H 15/64 24/DIG. 37 |
| 5,860,519 | A | 1/1999 | Meyer et al. | |
| 5,961,017 | A | 10/1999 | Mehler | |
| 6,330,944 | B1 | 12/2001 | DeMichele | |
| 6,520,327 | B1 | 2/2003 | Boardman et al. | |
| 6,793,112 | B2 * | 9/2004 | Ammerman | A45F 3/02 224/264 |
| 8,820,523 | B1 | 9/2014 | Breza et al. | |
| 8,870,045 | B1 | 10/2014 | Aguirre | |
| 8,919,628 | B2 | 12/2014 | Jamlang | |
| 9,049,916 | B2 | 6/2015 | Berei | |

(Continued)

*Primary Examiner* — Peter N Helvey

(74) *Attorney, Agent, or Firm* — Dunlap Bennett & Ludwig, PLLC

(57) ABSTRACT

A rigging and rail attachment system facilitating innumerable configurations for attaching different types of back-packable equipment thereto. The rigging and rail attachment system includes rails connecting two portions of material and thereby forming a channel therebetween. The channel extends generally perpendicular to the two portions of material in a first direction. A webbing extends from a portion of the channel in a second direction away from the channel, and the webbing has one or more aperture attachment points for engaging any detachable fastener that can operatively associated with an opening, whereby various objects can be attached to the rigging and rail attachment system in various configurations.

8 Claims, 4 Drawing Sheets

(56) References Cited

U.S. PATENT DOCUMENTS

| | | | | |
|---|---|---|---|---|
| 9,713,754 | B2 | 7/2017 | Herron et al. | |
| 10,058,751 | B2 | 8/2018 | Filip | |
| 10,201,734 | B2 | 2/2019 | Pactanac et al. | |
| 2006/0289586 | A1* | 12/2006 | Gregory | A45F 3/04 224/628 |
| 2007/0175941 | A1 | 8/2007 | Berry et al. | |
| 2007/0228091 | A1 | 10/2007 | Shawen | |
| 2008/0301912 | A1* | 12/2008 | Maley | A44B 1/08 24/114.7 |
| 2011/0204114 | A1 | 8/2011 | Miller | |
| 2012/0292355 | A1 | 11/2012 | Olson | |
| 2014/0061075 | A1 | 3/2014 | Leposky et al. | |

* cited by examiner

ATTACHMENT SYSTEM

CROSS-REFERENCE TO RELATED APPLICATION

This application claims the benefit of priority of U.S. provisional application No. 63/037,893, filed 11 Jun. 2020, the contents of which are herein incorporated by reference.

BACKGROUND OF THE INVENTION

The present invention relates to modular packing systems and, more particularly, a modular packing apparatus embodying a rigging and rail attachment system adapted to facilitate innumerable configurations for attaching different types of backpack components and backpackable equipment thereto.

The problem with current packing systems is that if a user has different types of equipment for different types of activities, they need multiple packing apparatuses, because there is not one packing system that is sufficiently configurable and/or modular to accommodate the different types of backpackable equipment for the different activities.

Most modular backpacks can only be configured in limited and specific ways, and so the user is restricted in their creativity. In short, current systems tend to be awkward and are limited in the ways their components and/or packed equipment can be attached and thus arrange or configured to the main backpack portion—i.e., their "modularity" does not provide the user true flexibility in the arrangements of the modules.

As can be seen, there is a need for a modular packing apparatus embodying a rigging and rail attachment system adapted to facilitate innumerable configurations for attaching different types of backpack components and backpackable equipment thereto.

The rigging and rail attachment system includes rails interconnecting two portions of material in such a way as to form a channel protruding inward into a compartment defined in part by the two portions. The rigging may include webbing having an inward portion that occupies a portion of the channel and an outward portion protruding outward into the exterior environment. Bar-tacking or other reinforcement may interconnect the rail and the inward portion. A plurality of apertures may be provided along the outward portion. Different pockets, hardware, webbing attachments, straps or other detachable fasteners can be affixed through each aperture for selectively attaching a myriad of different objects and equipment to a plurality of locations along the container/pack that provides the rigging and rail attachment system. The rails may replace or be placed where traditional seams would be present.

This system allows the user to configure and re-configure the attachments of a variety of objects (e.g., packing components, modules or equipment associated with very different activities) to a container/pack having the rigging and rail attachment system. Since the detachable fasteners can be affixed anywhere along the rigging and rail attachment system, the design maintains backpack functionality while still providing truly modularity. Thereby, the present invention solves the problem of needing multiple pack systems for different activities through enhancing flexible of a unitary pack having the rigging and rail attachment system of the present invention.

SUMMARY OF THE INVENTION

In one aspect of the present invention, a rigging and rail attachment system for a structure, the system includes the following: a rail interconnected to two portions of the structure in such a way as to define a channel extending in a first direction away from the two portions; a webbing having an inward portion occupying a portion of the channel; the webbing having an outward portion protruding the channel in a second direction away from the first direction; and one or more attachment points associated with the outward portion.

In another aspect of the present invention, the rigging and rail system includes a wherein each attachment point is an aperture, wherein the rail comprises one or more flexible flanges, and wherein the rail comprises one or more flanges, each rail having two opposing ends, each end connected to a peripheral edge of one of the two portions of the structure; and further including a reinforcement connecting the inward portion of the webbing and the one or more flanges, wherein each flange is a resilient non-metallic material, wherein the structure is an object defining a compartment and the channel extends into the compartment, and the outward portion protrudes into an external environment, wherein the object is a backpack, and wherein the rail is disposed along at least one seam of the backpack, and wherein the object is a backpack, and wherein the rail is disposed along at least five seams of the backpack.

These and other features, aspects and advantages of the present invention will become better understood with reference to the following drawings, description and claims.

DETAILED DESCRIPTION OF THE INVENTION

Figure 1:
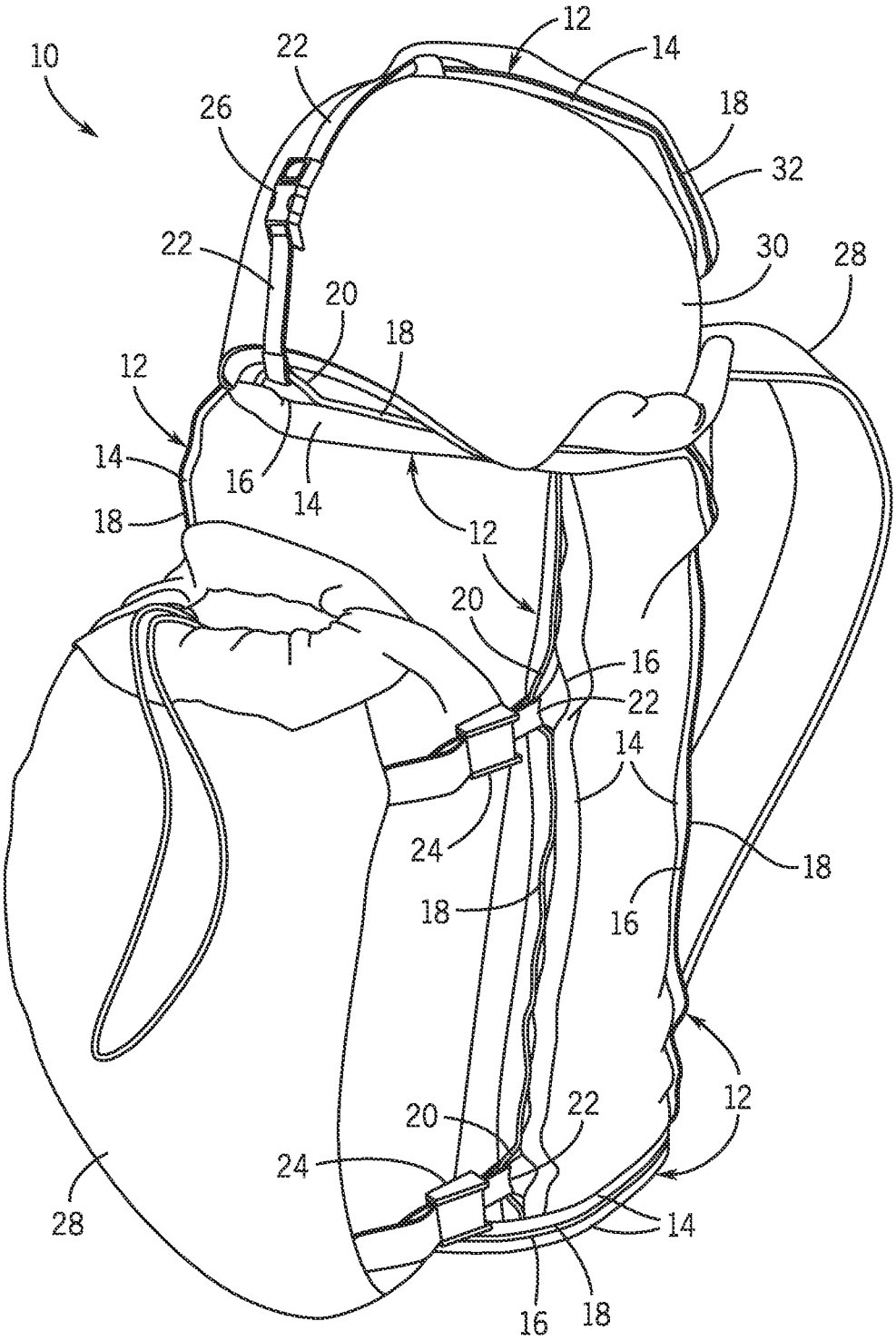
FIG. 1 is a perspective view of an exemplary embodiment of the present invention, shown in use.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

It should be understood by those skilled in the art that the use of directional terms such as inward (interior, inner, etc.) and outward (exterior, external, etc.) and the like are used in relation to the illustrative embodiments as they are depicted in the figures. Specifically, the inward direction being toward the bottom margin of FIG. 6, the outward direction being toward the top margin of FIG. 6.

Broadly, an embodiment of the present invention provides a modular packing apparatus embodying a rigging and rail attachment system facilitating innumerable configurations for attaching different types of backpackable equipment thereto. The rigging and rail attachment system includes rails connecting two portions of material and a channel extending generally perpendicular to the two portions of material in a first direction. A webbing extends from a portion of the channel in a second direction away from the channel, the webbing has one or more apertures and/or attachment points for engaging any detachable fastener that can operatively associated with an opening, whereby objects can be attached to the rigging and rail attachment system in various configurations.

Referring now to FIGS. 1 through 6, the present invention may include a rigging and rail attachment system 10. The rigging and rail attachment system 10 may include rails 12 interconnecting two portions of material 40 in such a way as to provide a channel 16 protruding generally perpendicularly relative to the two portions. The two portions of material 40 may, along with other portions of material 40, may define an exterior of a container or bag having an interior compartment into which the channel 16 extends.

Figure 6:
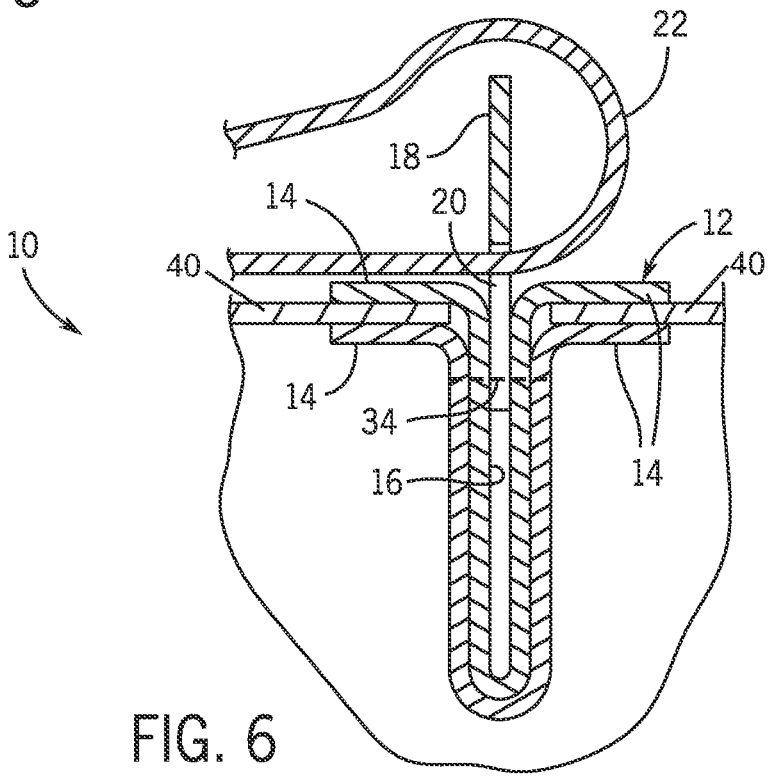
FIG. 6 is a section view of an exemplary embodiment of the present invention, taken along line 6-6 in FIG. 5.

The rail 12 may include one or more flexible, pliable, and/or durable flanges 14 whose two opposing ends connect to the two opposing edges of the two portions of the material 40, respectively. There may be two generally coextensively flanges 14 whose ends sandwich the two portions of the material 40, respectively, as illustrated in FIG. 6. Stitching or other joining methods (e.g., adhesive) may join the flange 14 ends to the edges of the portions of material 40.

The middle portion of the flange(s) 14 may form the channel 16 wherein the middle portion of the flange(s) 14 define a U-shape, wherein in certain embodiments, the length of the legs of the 'U' are longer than the length of the curvature, in some instance by at least a two to one ratio (legs to curvature).

A webbing 18, planar or otherwise may be dimensioned so that an inward portion of the webbing 18 occupies a portion of the channel 16 while an outward portion of the webbing 18 protrudes from the channel 16. A reinforcement 34, such as stitching, bar-tacking, a connector, or the like may connect the one or more flanges 14 and the inward portion of the webbing 18.

In the context of a container or bag 50 defined in part by the portions of the material 40, the channel 16 extends into the compartment defined by said container or bag 50, while the outward portion of the webbing 18 protrudes into the exterior environment. The channel 16 of the rigging and rail attachment system is thereby hidden in the compartment of the container/bag 50. The webbing 18 may be durable nylon or other natural or synthetic material. The webbing 18 and the channel 16 may more oblique than perpendicular relative to the rails 12. For example, the outward portion of the webbing 18 may be at a thirty-degree angle (or more or less) relative to the rail 12, even though the FIGS. Show generally perpendicular.

A one or more apertures 20 may be provided by the webbing 18. Each aperture 20 affords an attachment point for a detachable fastener, whereby an object 28 can be attached to the rigging and rail attachment system 10. Even though a few fasteners are shown in the appended figures it should be understood that any fastener that can connected one object to another object through engaging or using the aperture 20 may be utilized. The outward portion may protrude from the channel 16 by at least a quarter of an inch. The aperture 20 may be spaced at least an eighth of an inch from a peripheral edge of the outward portion.

In certain embodiments, the attachment points 20 may not be apertures, openings, elongated slits, or voids as shown in the appended FIGS. Rather, the attachment points 20 may be a connector of other types capable of connecting one object to another, such as but not limited to snaps, paramagnetic material, and the like.

Figure 2:
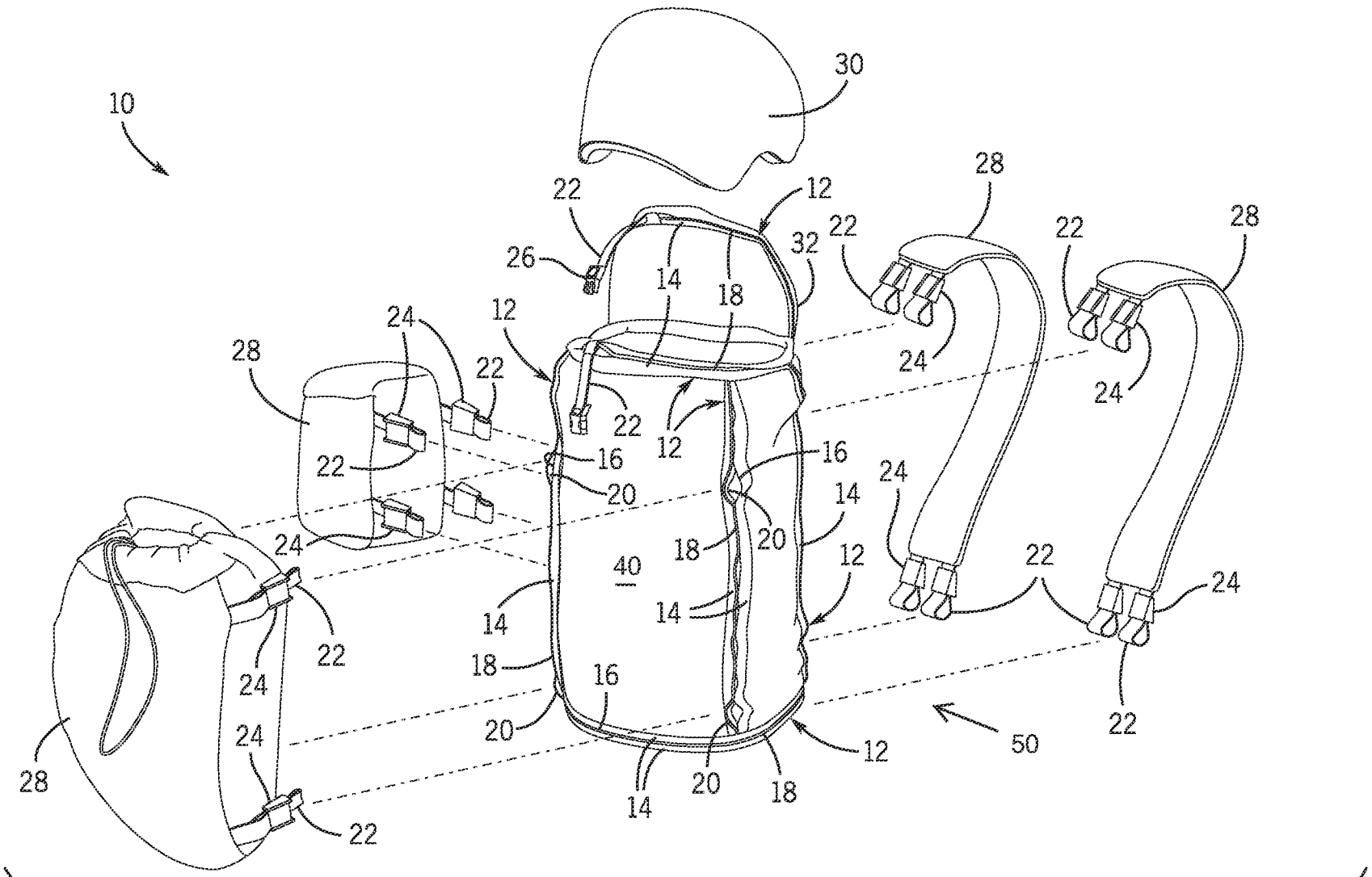
FIG. 2 is an exploded perspective view of an exemplary embodiment of the present invention.

The length that the rail 12 and or webbing 18 that extends along the portions of materials 40 and the resulting channel 16 may vary from what is shown in the appended FIGS. For instance, instead of one elongated webbing 18 extending the vertical length of the container/bag 50, as shown in FIG. 2, there may be a plurality of short webbing 18 pieces, each with only one (or more) aperture 20. Likewise, the rail 12 need not extend the entire length of the container/bag 50, but may themselves be spaced apart and so on.

The webbing 18 may include nylon, polypropylene or polyester or similar heavy-duty material. approximately ½ inch thick length of webbing 18 may be secured at regular intervals. As used in this application, the term "about" or "approximately" refers to a range of values within plus or minus 10% of the specified number.

The reinforcement 34 may be a pattern of bar tacks or similar method of securely fastening the webbing 18 to itself (and securing another, smaller piece of webbing 18) and/or to the flanges 14.

Detachable fasteners that may engage the attachment points/apertures 20 may include, but are not limited to, straps 22, clasps 24, buckles 26, cord, elastic or inelastic.

Attachments 28 to the rigging and rail attachment system 10 that are possible via the detachable fasteners are, but not limited to, removable shoulder straps, wherein approximately one-inch width of webbing forms the lower half of a shoulder strap or a webbing lashing strap, end loop of a choker hitch used to attach webbing to the rigging rail, removable side pockets for water bottles or similar articles, a top closure 32 of backpack, a helmet 30, a large front pocket for items that need to be readily accessible, an ice axe pocket, side lashing straps for skis or other long item, skis or other long object like trekking or tent polls, small webbing or elastic loop for handle of ice tools or similar, insulated, removable side or internal beverage container pocket, snowboard, skateboard or similar long and wide item, small internal organizational pockets, large internal organizational pocket, a yoga mat or similar rolled up foam pad, a removable hip belt, webbing loops, a removable backpack brain, rope carry, cord opening on rigging tool, pointed end of rigging tool, long cylindrical arm of the rigging tool of various diameters.

FIGS. 3 through 6, shows the one or many methods of attaching a strap 22, and other attachments, to the main pack 50; demonstrating demonstrates the method of attaching a length of ¾-inch wide or less nylon, polyester, or polypropylene webbing 18 to the main pack 50. The end loop created by box stitching in the webbing back onto itself to create an opening, is passed through the channel and out on the other side of a bar tack or reinforced segment of webbing 18. With one end secure the pack the other end of the webbing can be used in a ladder lock, buckle, g hook, or other similar closure hardware. This loop system can be used with cord as well. Alternatively, loops made of webbing or cord may be sewn into the attachment with spacing corresponding to the apertures 20 in the webbing 18 rail. A cord, elastic or inelastic, may be run through the webbing channel 16 and the attachment points 20. The cord may then be tightened, drawing the loops into the channel 16.

Figure 3:
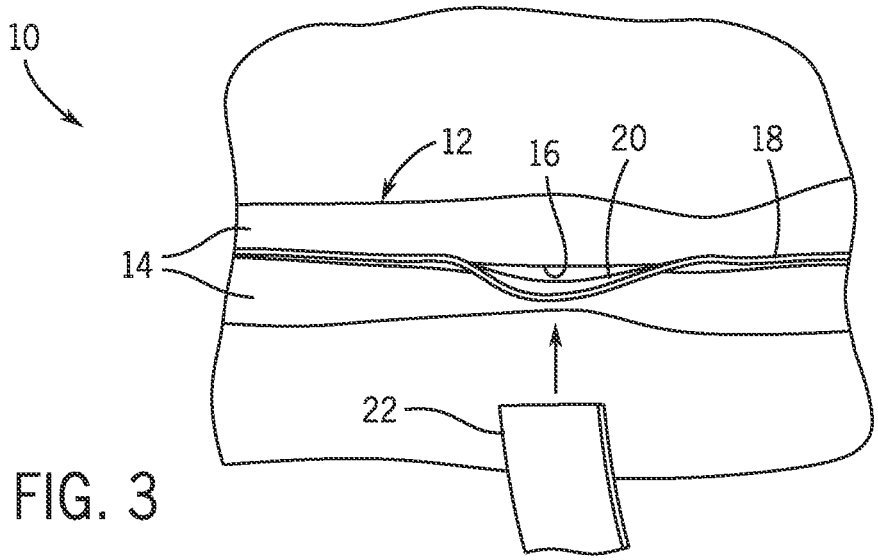
FIGS. 3-5 are front elevation views of an exemplary embodiment of the present invention for illustrating the process of detachable fastening to a rigging and rail attachment system.
Figure 4:
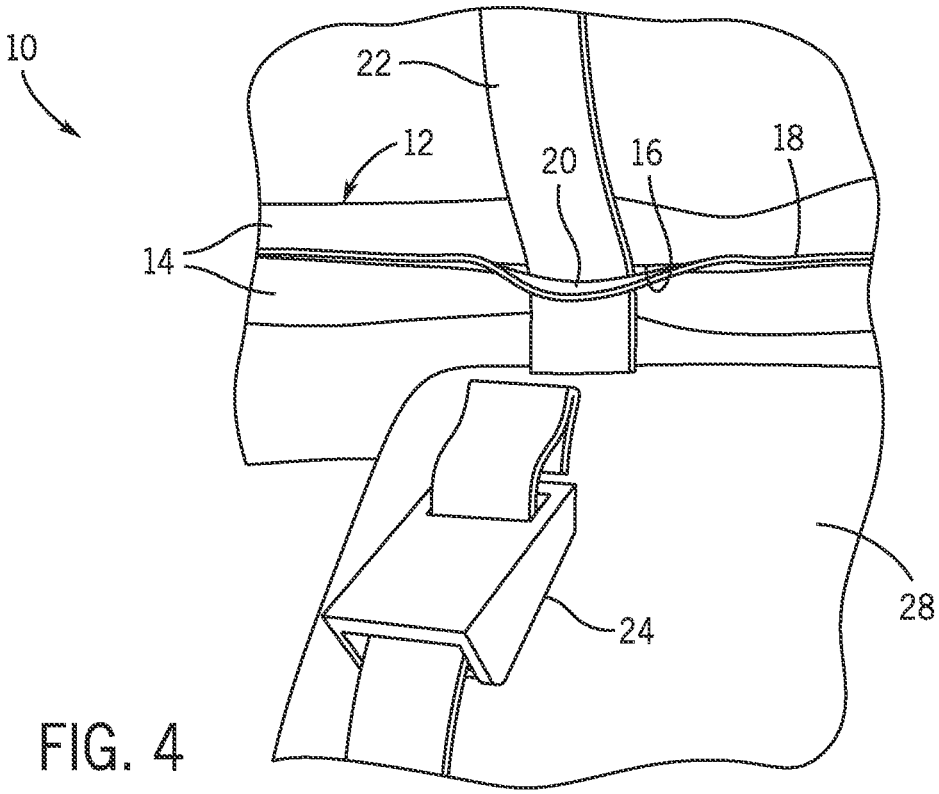
Figure 5:
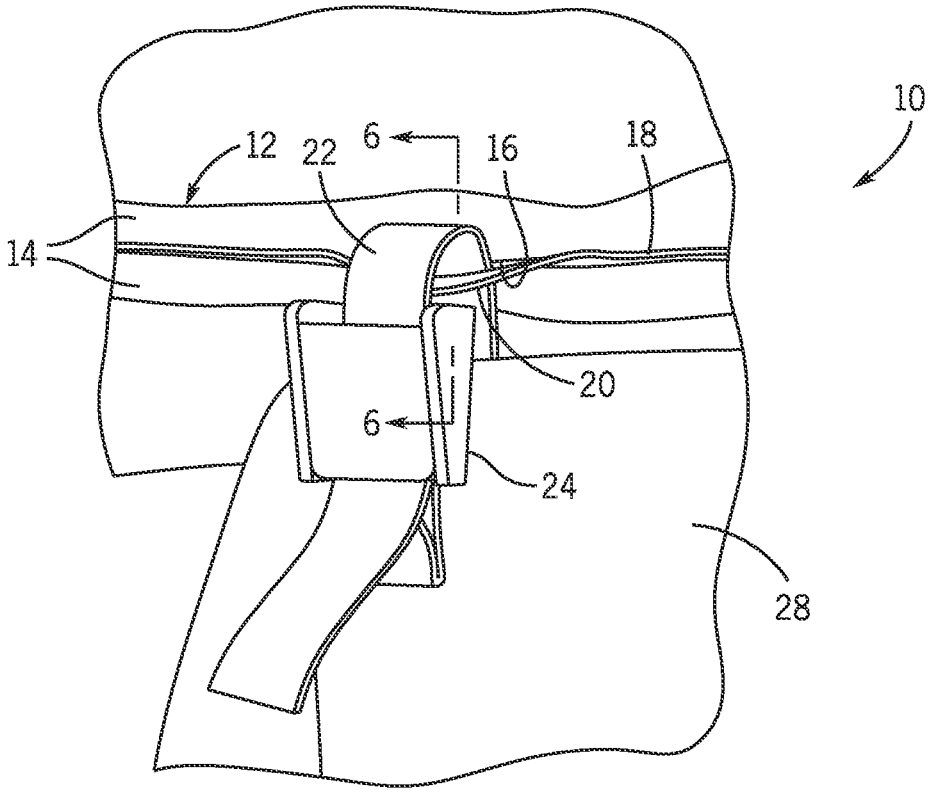

FIG. 2 shows a typical backpacking set up. A large front pocket and two side pockets, attached by the method shown in FIGS. 3-5—loops in the corners of the attachment, through which cord is run and pulled into the webbing channel. These attachments can be made of an elastic mesh or an inelastic pack cloth. These pockets can have drawstring openings, zipper closures, or other closure methods typical for backpacks. The top closure 32 of the bag may be secured with two webbing straps 22 connected to a male and female end of plastic buckles 26, affixed as shown in FIGS. 3-5.

The rail 12 may be made of a length of nylon webbing bar tacked with reinforcing material in a pattern such that there is a channel 16 that has openings and lashing points and is sewn into the main seams of a pack bag. A cord (elastic or inelastic) may run through the channel 16 and secured in a loop by a cord lock. An overhand knot can be tied to further secure the loop. When this cord is tightened, it pulls the webbing loops of the attachment into the channel of the seam, ideally obscuring the presence of the loop and attachment system from view. This tightening of the cord will also compress the load against the users back, increasing load carrying ability. A compressed bag moves less and has a reduced moment arm of the load from the back. Attachments can also be hooked on for a less secure but more convenient method of attachment. A second method may include by running a cord or webbing (8) strap with a loop in the end through a rigging aperture 20 and then back through itself to make a secure connection to the base pack via a choker hitch around the bar tack 34 or webbing 18. This strap can be attached to another strap similarly affixed via a plastic buckle or g-hook. The third method will be the primary method of attachment for the lower nylon webbing portion of the shoulder strap attachments. The pack body may be made of waterproof, abrasion resistant, coated fabric or laminate. There is a special tool invented to easily thread cord through the channels and attachments to quickly configure the pack. There may be a tool that makes it easier for the user to configure the pack. It will be a long cylindrical rod with one end designed to have cord affixed to it and pointed so it easily runs through the channels of the pack and the polyester or nylon webbing loops on the attachments.

The pack is to have a rectangular prism body with rigging rails along each edge. The top of the pack is to be finished with an extendable roll top or drawstring top. The pack is designed to have multiple options for shoulder straps, lids, hip belts, frame systems, external and internal storage pockets, and a variety of lashing straps for a fully customizable packing system.

The rails may be created by first cutting 4 vertical rails, two rail circles for the bottom and top of the main compartment, and one rail for the load lifter attachment. Slits may then be cut by blade or laser in a 1½" cut then ½" solid up and down the length of the fabric or webbing. The 3" webbing or fabric is then bar tacked to make a 1" channel. The bar tacks are ½" long and are even with the solid portion of the slit pattern. A length of ½" webbing may be secured in the channel by the bar tacks to make lashing points. Then panels of pack cloth are sewn to the four vertical channels to form the body. The bottom panel is sewn to the bottom rigging loop and then the bottom rigging loop is sewn to the main body of the pack. The top rigging loop is attached in a similar fashion. The synch or roll top is then sewn to the top with the load lifter rail sewn in approximately 3" above the upper rigging loop. The rigging rails are designed to be placed anywhere a normal backpack seam could be located.

Backpacks are used to carry articles for utility, safety, and enjoyment. For every use of a backpack there is an ideal configuration for the user to achieve their goals. These arrangements consist of shoulder strap selection and placement, pocket type and placement, frame style, main compartment access, and interior organization. Each pack on the market has narrow applications or an inefficient and unappealing method of modularity. The key to most modular backpack systems is a series of nylon webbing loops on the outside of a main compartment and large clips that pockets and other attachments are affixed to. There are also permanently affixed plastic and metal buckles that correspond to a specific set of attachments for a specific line of attachment applications. In my system the webbing loops are hidden in the main seams, maintaining a clean, uninterrupted exterior.

Also, the present invention can be used in any field where articles must be carried and organized for recreation or utility.

It should be understood, of course, that the foregoing relates to exemplary embodiments of the invention and that modifications may be made without departing from the spirit and scope of the invention as set forth in the following claims.

What is claimed is:

1. A rigging and rail attachment system for a structure, the system comprising:

a rail interconnected to two portions of the structure in such a way as to define a channel extending in a first direction away from the two portions;

a webbing having an inward portion occupying a portion of the channel;

the webbing having an outward portion protruding the channel in a second direction away from the first direction; and one or more attachment points associated with the outward portion, wherein the rail comprises one or more flanges, each rail having two opposing ends, each end connected to a peripheral edge of one of the two portions of the structure.

2. The system of claim 1, wherein each attachment point is an aperture.

3. The system of claim 1, wherein each flange is flexible.

4. The system of claim 1, further comprising a reinforcement connecting the inward portion of the webbing and the one or more flanges.

5. The system of claim 1, wherein each flange is a resilient non-metallic material.

6. The system of claim 5, wherein the structure is an object defining a compartment and the channel extends into the compartment, and the outward portion protrudes into an external environment.

7. The system of claim 6, wherein the object is a backpack, and wherein the rail is disposed along at least one seam of the backpack.

8. The system of claim 7, wherein the object is a backpack, and wherein the rail is disposed along at least five seams of the backpack.

* * * * *